US008565945B2

(12) United States Patent
Allshouse et al.

(10) Patent No.: US 8,565,945 B2
(45) Date of Patent: Oct. 22, 2013

(54) METHOD FOR MANAGING VITAL TRAIN MOVEMENTS

(75) Inventors: Richard A. Allshouse, Manassas, VA (US); Robert B. Groves, Jr., Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 867 days.

(21) Appl. No.: 12/356,408

(22) Filed: Jan. 20, 2009

(65) Prior Publication Data

US 2009/0184212 A1 Jul. 23, 2009

Related U.S. Application Data

(60) Provisional application No. 61/021,856, filed on Jan. 17, 2008.

(51) Int. Cl.
*E05B 73/00* (2006.01)
*B61L 25/00* (2006.01)

(52) U.S. Cl.
USPC ..... 701/19; 246/122 R

(58) Field of Classification Search
USPC ..... 246/20, 27, 28 R, 33, 40, 34 A, 34 B, 246/122 R, 131, 132; 701/19, 20
See application file for complete search history.

(56) References Cited

U.S. PATENT DOCUMENTS

| | | | | |
|---|---|---|---|---|
| 5,533,695 | A * | 7/1996 | Heggestad et al. | 246/62 |
| 5,950,966 | A * | 9/1999 | Hungate et al. | 246/62 |
| 6,587,763 | B2 * | 7/2003 | Ishikawa | 701/19 |

FOREIGN PATENT DOCUMENTS

| | | | |
|---|---|---|---|
| EP | 1498338 | A1 | 1/2005 |
| EP | 1752355 | A2 | 2/2007 |
| WO | 9315946 | A1 | 8/1993 |

OTHER PUBLICATIONS

Janhsen, Axel, "PCT Application No. PCT/US2009/031495 International Search Report Apr. 15, 2009", , Publisher: PCT, Published in: PCT.

Abaz, Lejla, "AU Application No. 2009205883 Office Action Mar. 24, 2011", , Publisher: IPA, Published in: AU.

Abaz, Lejla, "AU Application No. 2009205883 Office Action Jan. 3, 2012", , Publisher: IPA, Published in: AU.

* cited by examiner

*Primary Examiner* — R. J. McCarry, Jr.

(74) *Attorney, Agent, or Firm* — Kaplan Breyer Schwarz & Ottesen LLP

(57) ABSTRACT

A method for communicating safety critical train authorization under the conditions of limited communications capability is disclosed.

20 Claims, 5 Drawing Sheets

METHOD FOR MANAGING VITAL TRAIN MOVEMENTS

This case claims priority of U.S. Provisional Patent Application Ser. No. 61/021,856, which was filed on Jan. 17, 2008 and which is incorporated herein by reference.

FIELD OF THE INVENTION

The present invention relates to rail systems in general, and, more particularly, to methods for controlling the movement of trains through a rail system.

BACKGROUND OF THE INVENTION

Vital train movements include the required enforceable "movement authority" for a train operating on controlled track. This movement authority (data) must be transmitted from a controlling entity to the train, both at the trip origin and while the train is en route. Since this is critical train control data, the exchange of the data must be performed in a vital manner. Furthermore, the data onboard must be verified as being current at a frequent rate to avoid operating with stale or missing data.

Communications between the train and a controlling entity is expected to be over a wireless communications path where bandwidth considerations are paramount. Often, the available communications channels offer relatively low bandwidth and high-latency. Yet, this bandwidth is required to support data exchanges between the controlling entity and all the operating locomotives as well as all equipped wayside devices. Minimal communications latency is a key design consideration to deliver and maintain the vital data and react quickly to changes in the operating environment, such as loss of communications.

SUMMARY OF THE INVENTION

For movement authority vitality, there are two areas of primary concern:

1. no movement authority can be granted which is unsafe (based upon the authorities granted to other trains and upon the current switch settings); and
2. no movement authority can be reduced (i.e., rolled up/removed) if a train is still occupying its limits.

Concern no. 1 is handled by checking that no vital movement authorities have already been granted over any section of track that overlaps the proposed authority (except as rules permit) and also validating with the vital switch data that no switches are aligned improperly. Any conflict that is discovered causes, at a minimum, the movement authority to be rejected and potentially causes all conflicting authorities to be truncated at the point of requested overlap. The reason for rejection is returned to the non-vital components. The non-vital components may then attempt to propose a new authority with smaller limits, facilitating stacking of authorities.

Concern no. 2, reducing movement authorities, can also create an unsafe condition. In particular, if a train is still occupying the limits of the authority it was granted, the track must still be protected. If not, a new authority might be granted to a different train which puts it on the same track as the original train. This is especially true if automatic rollup of movement authorities is being performed on a leading train and given to the following train immediately in a moving block operation.

Updating the full movement authority for either case can be problematic with low-bandwidth/high-latency communications between a centralized server responsible for generating/modifying the movement authorities and the locomotive system, which must enforce the movement authorities.

In accordance with the illustrative embodiment of the present invention, the full movement authority that a train is expected to be granted (based upon the dispatcher's Track Authority) is transmitted to the train in advance, ideally under the high-bandwidth condition of a train yard. In accordance with the present invention, the definition of the movement authority includes a partitioning or segmenting of the full movement authority into much smaller "partial movement authorities" or "PMAs." These partial movement authorities represent smaller segments within the movement authority.

The controlling entity provides, through regular messages, such as the Health Monitoring message (which contains information related to the vital data maintained by both the train and the controlling entity), the current limits of authority by including PMA information periodically. A train's onboard system would update the current limits of authority based upon this information.

This method therefore enables the current authority to be truncated or rolled up in a timely manner. Since only PMAs have to be sent upon authority update, rather than the full movement authority as in the prior art, the effects of low bandwidth or high latency networks are substantially reduced.

Also, since roll-up of authority occurs timely and on a regular basis, the separation between adjacent trains can be reduced, relative to the prior art. That is, once a first train has exceeded some of the authority it was granted, that portion of the authority is no longer required for the train. Since, in accordance with the illustrative embodiment, movement authority is segmented into a plurality of discrete or "partial" movement authorities, the partial authorities that are no longer necessary can be rolled-up (i.e., withdrawn) and granted to a second train that follows the first train.

Furthermore, if communication is lost, the train will not have true permission onboard to move across the entire movement authority limits. Rather, it will only have the permissions in the smaller set (i.e., the particular PMA) given in the last Health Monitoring message before the communications loss. At that point, railroad-specific rules for how to proceed over the limits of a movement authority without vital PMA confirmation will take effect (e.g., enforced move at a reduced speed, stop at limit of PMA, etc.).

DETAILED DESCRIPTION

Figure 1:
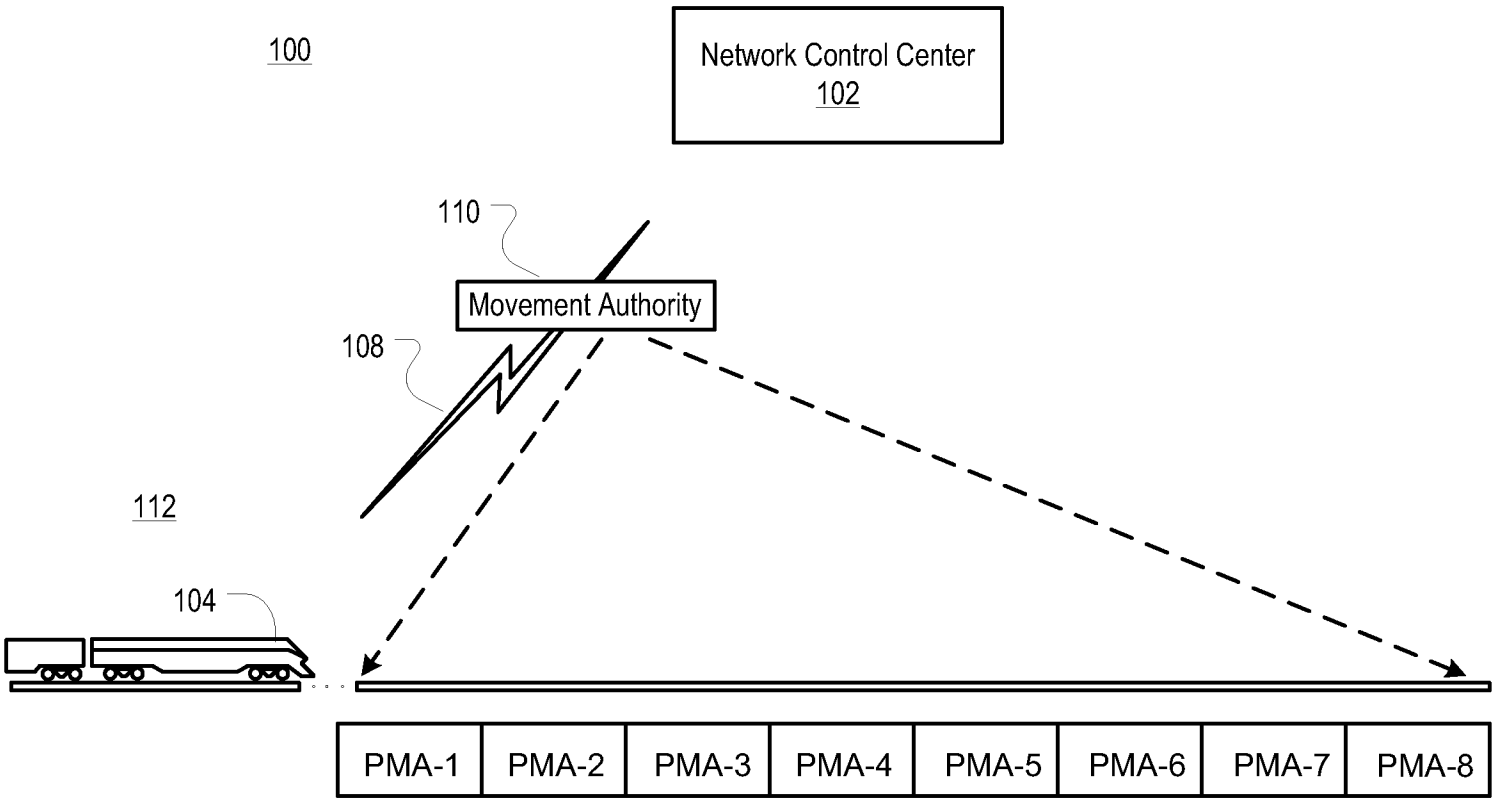
FIG. 1 depicts the manner in which movement authority is partitioned into a plurality of partial movement authorities.

FIG. 1 depicts territory 100, which represents a portion of a railroad network. Network control center 102 is responsible for controlling trains within territory 100, such as train 104.

In accordance with the illustrative embodiment, full movement authority 110 that train 104 is expected to be granted (i.e., based on a dispatcher's Track Authority) is sent to the train in advance over communications channel 108, advantageously under the high-bandwidth conditions in train yard 112.

In accordance with the present invention, movement authority 110 is partitioned into much smaller "partial movement authorities" or "PMAs." These partial movement authorities represent smaller segments of full movement authority 110. Each partial movement authority provides permission for the train to proceed over a specific portion of track.

In the illustrative embodiment, movement authority 110 is sub-divided into eight partial movement authorities: PMA-1 through PMA-8. The division of movement authority 110 into eight partial movement authorities is strictly for illustrative purposes. In conjunction with the present disclosure, those skilled in the art will know how to subdivide movement authority into any convenient number of partial movement authorities.

Figure 2:
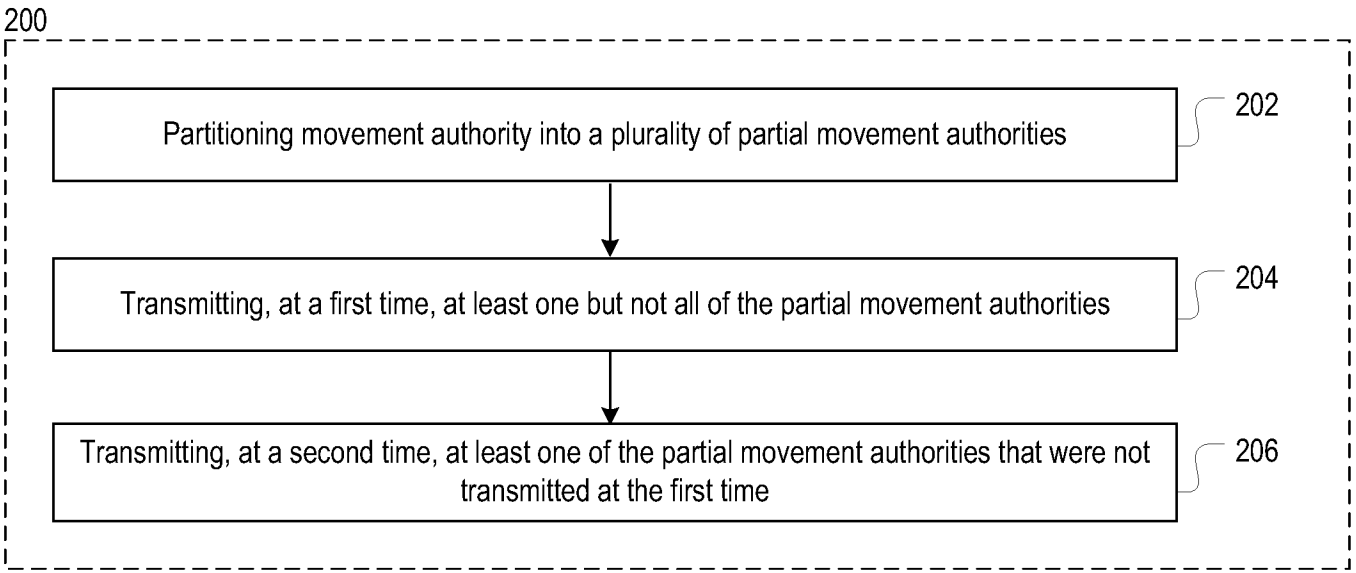
FIG. 2 depicts a method in accordance with the illustrative embodiment of the present invention.

FIG. 2 depicts method 200 in accordance with the illustrative embodiment of the present invention. The method is operating within the server of a control center and within the on-board system of a train. In other words, the method is implemented as software suitable for running on the processor.

In accordance with operation 202 of method 200, the expected full movement authority is partitioned into a plurality of partial movement authorities. Each partial movement authority represents the authorization for the train to movement over a portion of track.

Operation 204 recites transmitting, at a first time, at least one, but not all of the partial movement authorities to the train. As the train proceeds, partial movement authority information is periodically transmitted to the train from the controlling entity (i.e., a network control center). This is the process of updating the movement authority. In the prior art, this process involves transmitting the full movement authority, as updated to include any changes. By contrast, in the illustrative embodiment of the present invention, only a relevant and much smaller portion of the movement authority—namely, one or more partial movement authorities, are transmitted to the train.

The information pertaining to the partial movement authorities can be transmitted in conjunction with the routinely-transmitted "health monitoring message." The health monitoring message nominally contains information pertaining to the vital data maintained by the train and the controlling entity. In accordance with the illustrative embodiment, the health monitoring message will also provide information pertaining to the current limits of authority per the included partial-movement-authority information.

As per operation 206, as the train proceeds, subsequent transmissions (e.g., health monitoring messages, etc.) will include further updates pertaining to then relevant partial movement authorities.

Figure 3:
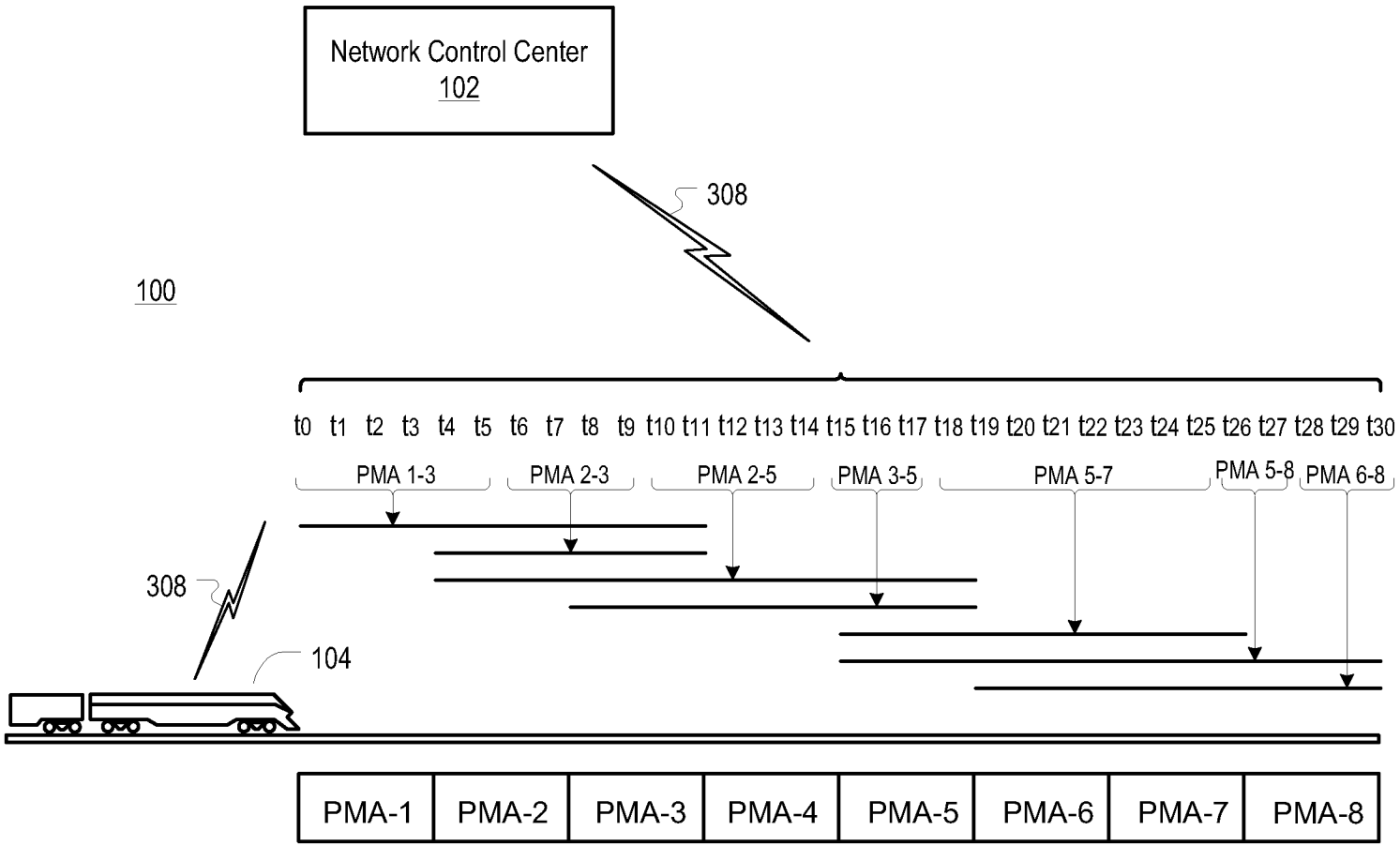
FIG. 3 depicts the transmission to and roll-up of the partial movement authorities granted to a train over time.

FIG. 3 depicts the transmission, over wireless channel 308, of partial movement authorities PMA-1 through PMA-8, over the course of time t0 through t30 as train 104 proceeds along the track.

As depicted in FIG. 3, between time t0 and t5, train 104 is granted partial movement authorities PMA-1 through PMA-3. During that time, updates concerning those partial movement authorities may be received by train 104 over communications channel 308. Between time t6 to t9, partial movement authority PMA-1 is rolled-up since train 104 has exceeded that authority (passed that portion of track). During that time period, the train is still operating under partial movement authorities PMA-2 and PMA-3.

In the time period t10 through t14, train 104 is granted partial movement authorities PMA-2 through PMA-5. During that time, updates concerning those partial movement authorities may be received by train 104 over communications channel 308. Note that partial movement authority PMA-2 has not yet been rolled-up.

Between times t15 to t17, partial movement authority PMA-2 is rolled up. Train 104 is operating under partial movement authorities PMA-3 through PMA-5. Updates pertaining to those partial movement authorities will be received by the train during this period of time.

Beginning at time t18, partial movement authorities PMA-3 and PMA-4 are rolled-up and the train is operating under partial movement authorities PMA-5 through PMA-7 through time t25. Train 104 will receive updates over communications channel 308 pertaining to partial movement authorities PMA-5 through PMA-7.

Between time t26 through t27, train 104 is granted additional partial movement authority PMA-8. During this time period, train 104 will receive updates over communications channel 308 pertaining to partial movement authorities PMA-5 through PMA-8.

At time t28, partial movement authority PMA-5 is rolled-up. Between time t28 and t30, train 104 operates under partial movement authorities PMA-6 through PMA-8. During this period of time, the train will receive updates over communications channel 308 pertaining to partial movement authorities PMA-6 through PMA-8.

In this fashion, partial movement authorities are sequentially granted and rolled-up as the train proceeds along the track.

Figure 4:
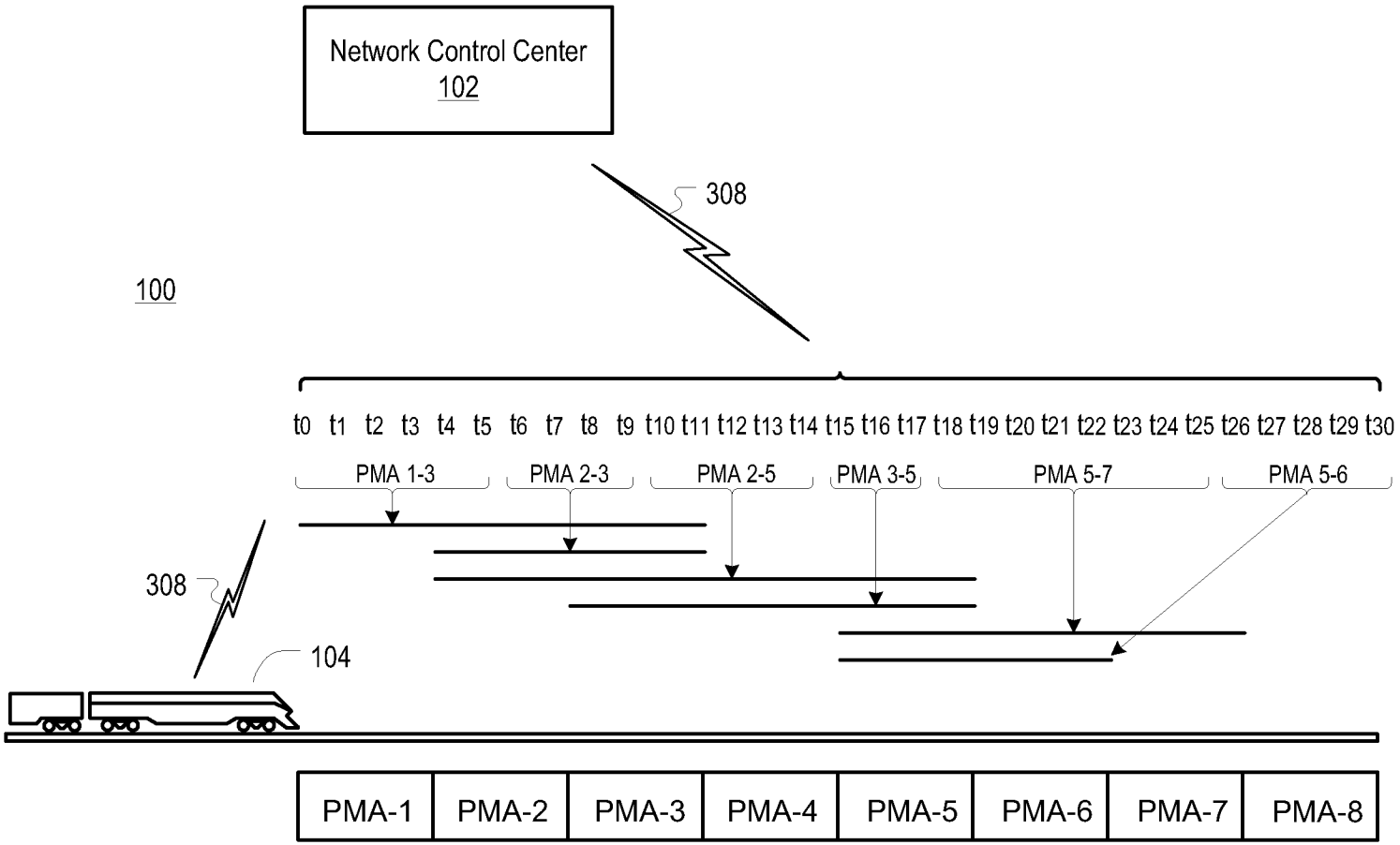
FIG. 4 depicts a truncation of authority wherein not all PMAs are received by the train.

FIG. 4 depicts a scenario in which authority is truncated. As depicted in that Figure, at time t26, partial movement authority is truncated with the loss of partial movement authorities PMA-7 and PMA-8 (compare FIG. 3). Note also that with the loss of partial movement authorities PMA-7 and PMA-8, there was no roll-up of partial movement authority PMA-5 at time t28 (compare to FIG. 3).

Figure 5:
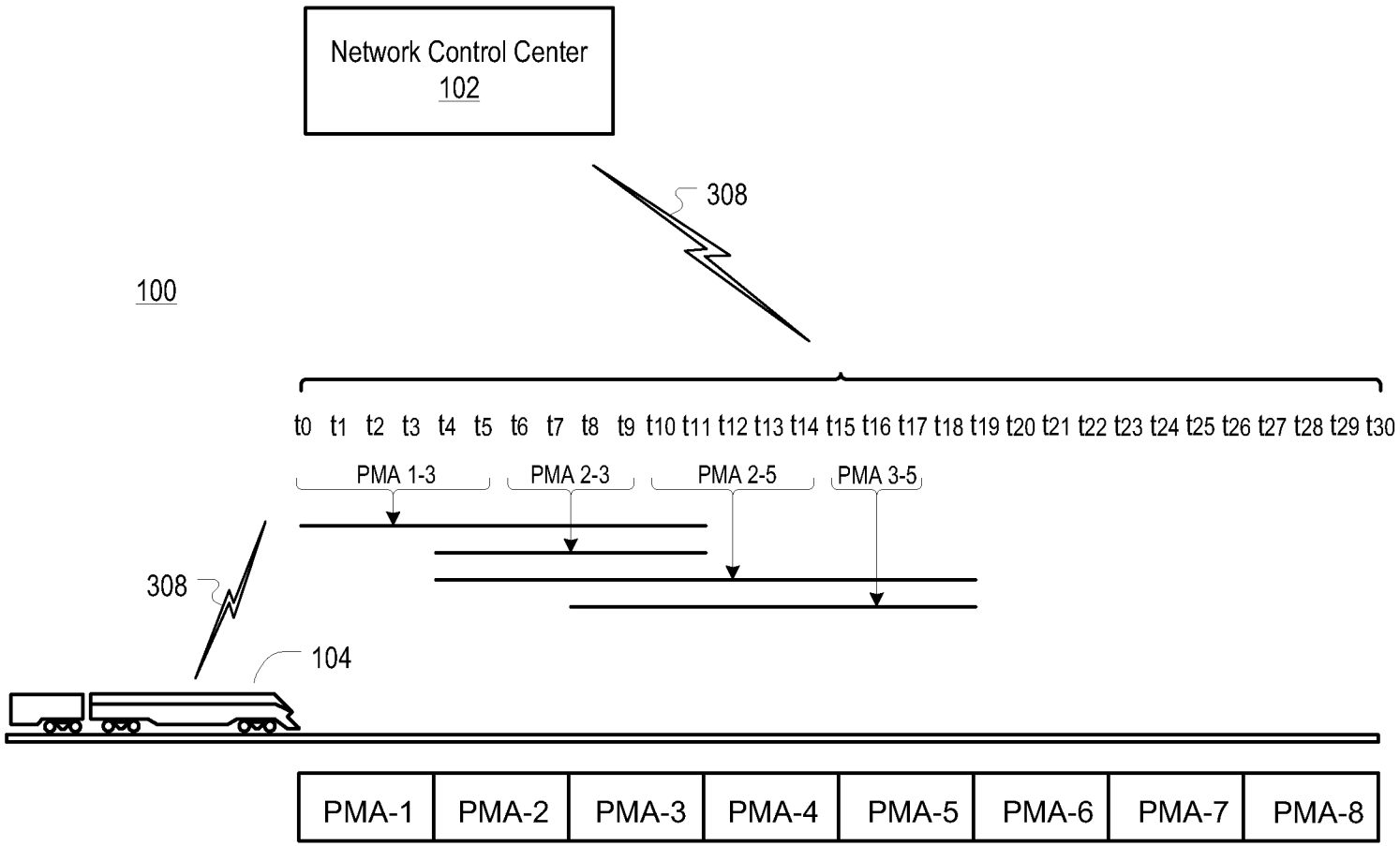
FIG. 5 depicts the effect of lost communications. Some PMAs are not received and train movement beyond the last-received PMA depends on railway operating procedures.

FIG. 5 depicts a scenario in which communications are lost at t18. Up to time t17, train 104 has been granted partial movement authorities PMA-3 through PMA-5. Train movement beyond PMA-5 is dependent upon corporate railway operating procedures. At that point, railroad-specific rules for how to proceed over the limits of a movement authority without vital partial movement authority confirmation will take effect. Those rules might specify, for example, that train 104 proceed at reduced speed or that train 104 stop at the limit of partial movement authority PMA-5.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method for controlling vital train movement of a train from a central server that is not onboard the train, the method comprising:

partitioning, by the server, a full movement authority for the train into a plurality of partial movement authorities, wherein each partial movement authority is a subset of the full movement authority;

transmitting by the server directly to the train, at a first time, at least one but not all of the partial movement authorities; and transmitting by the server directly to the train, at a second time, at least one of the partial movement authorities that were not sent at the first time.

2. The method of claim 1 wherein the partial movement authorities are transmitted via a plurality of health monitoring messages.

3. The method of claim 1 further comprising truncating the full movement authority by not transmitting all of the partial movement authorities to the train.

4. The method of claim 3 wherein when direct communication between the train and the server is lost and at least one partial movement authority is not received by the train, the train operates under pre-existing railroad-specific rules, and not under the truncated full movement authority.

5. The method of claim 1 further comprising:

transmitting by the server directly to the train the expected full movement authority, prior to the first time, via a first communication channel.

6. The method of claim 5, wherein at least one of (i) the transmitting to the train at the first time and (ii) the transmitting to the train at the second time is via a second communication channel that has a lower bandwidth than the first communication channel.

7. The method of claim 5 wherein at least one of (i) the transmitting to the train at the first time and (ii) the transmitting to the train at the second time is via a second communication channel that has a higher latency than the first communication channel.

8. The method of claim 1 wherein at least one of (i) the transmitting to the train at the first time and (ii) the transmitting to the train at the second time is at a lower bandwidth than when transmitting the expected full movement authority.

9. The method of claim 1 wherein at least one of (i) the transmitting to the train at the first time and (ii) the transmitting to the train at the second time has a higher latency than when transmitting the expected full movement authority.

10. A method for controlling vital train movement of a train from a central server that is not onboard the train, the method comprising:

receiving, by the train directly from the server, at a first time, a full movement authority;

receiving, by the train directly from the server, at a second time, one of a plurality of partial movement authorities, wherein each partial movement authority in the plurality is a subset of the full movement authority; and receiving, by the train directly from the server, at a third time, at least one of the plurality of partial movement authorities that were not received at the second time.

11. The method of claim 10 wherein the first time is before the second time and also before the third time.

12. The method of claim 10 wherein the partial movement authorities are received via a plurality of health monitoring messages directly from the server.

13. The method of claim 10 wherein when direct communication between the train and the server is lost and at least one partial movement authority is not received by the train, the train operates under pre-existing railroad-specific rules, and not under the full movement authority.

14. The method of claim 10 wherein at least one of (i) the receiving at the second time and (ii) the receiving at the third time is via a second communication channel that has a lower bandwidth than a first communication channel used for receiving at the first time.

15. The method of claim 10 wherein at least one of (i) the receiving at the second time and (ii) the receiving at the third time is via a second communication channel that has a higher latency than a first communication channel used for receiving at the first time.

16. The method of claim 10 wherein at least one of (i) the receiving at the second time and (ii) the receiving at the third time is via a lower bandwidth than the receiving at the first time.

17. The method of claim 10 wherein at least one of (i) the receiving at the second time and (ii) the receiving at the third time is with a higher latency than the receiving at the first time.

18. The method of claim 1 wherein a partial movement authority is an update to the corresponding information in the full movement authority.

19. The method of claim 10 wherein a partial movement authority is an update to the corresponding information in the full movement authority.

20. A method for controlling vital train movement of a train from a central server that is not onboard the train, the method comprising:

partitioning, by the server, a full movement authority for the train into a plurality of partial movement authorities, wherein each partial movement authority is a subset of the full movement authority;

transmitting, by the server directly to the train, at least one but not all of the partial movement authorities;

transmitting, by the server directly to the train, at least one of the partial movement authorities that were not sent at the first time; and when an update to the full movement authority is to be transmitted to the train, transmitting the update, by the server directly to the train, via one or more partial movement authorities, and not by transmitting an updated full movement authority.

* * * * *